US008622518B2

(12) United States Patent
Usuda et al.

(10) Patent No.: US 8,622,518 B2
(45) Date of Patent: Jan. 7, 2014

(54) PRINTING APPARATUS AND PRINTING METHOD

(71) Applicant: Seiko Epson Corporation, Tokyo (JP)

(72) Inventors: Hidenori Usuda, Matsumoto (JP); Takayoshi Kagata, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/660,300

(22) Filed: Oct. 25, 2012

(65) Prior Publication Data

US 2013/0106955 A1 May 2, 2013

(30) Foreign Application Priority Data

Oct. 28, 2011 (JP) ..... 2011-236930

(51) Int. Cl.
*B41J 2/21* (2006.01)

(52) U.S. Cl.
USPC ..... 347/43; 347/15; 347/98

(58) Field of Classification Search
USPC ..... 347/15, 21, 43, 95–100
See application file for complete search history.

(56) References Cited

U.S. PATENT DOCUMENTS 7,153,561 B2 * 12/2006 Larson et al. ..... 428/195.1

FOREIGN PATENT DOCUMENTS

JP 08-150800 6/1996
JP 2004-122505 4/2004

* cited by examiner

*Primary Examiner* — Thinh Nguyen
(74) *Attorney, Agent, or Firm* — Workman Nydegger

(57) ABSTRACT

A printing apparatus includes: a first nozzle for ejecting clear ink to form a first dot; and a second nozzle for ejecting color ink to form a second dot, wherein, when forming a color image on a photoluminescent ground layer by means of the second dot, the first dot is formed at an area where the color image does not exist.

6 Claims, 8 Drawing Sheets

PRINTING APPARATUS AND PRINTING METHOD

CROSS-REFERENCE TO RELATED APPLICATION

The entire disclosure of Japanese Patent Application No. 2011-236930, filed Oct. 28, 2011 is expressly incorporated by reference herein.

BACKGROUND

1. Technical Field

The present invention relates to a printing apparatus and a printing method.

2. Related Art

Ink-jet printers for forming an image by ejecting ink are widely used. One expected way or mode of printing by such an ink-jet printer is to form a photoluminescent ground first and then print a color image on the photoluminescent ground. Another expected way or mode of printing by such an ink-jet printer is to print a color image on a print target medium that has photoluminescent properties. Examples of the related art are disclosed in JP-A-2004-122505 and JP-A-8-150800.

In general, a copying machine copies the original image, etc. by detecting diffuse color component of diffused reflection light. When there exists a color image formed on a photoluminescent ground, the percentage of diffused reflection light is lower than that of a case where there exists a color image formed on a piece of ordinary paper. For this reason, if there exists a color image formed on a photoluminescent ground, a copying machine might fail to detect diffuse color component of diffused reflection light, which results in that color-image copying is not performed properly. Thus, the development of a technique that makes it possible to perform copying properly even when a target printed matter includes an image formed on a photoluminescent background is awaited.

SUMMARY

An advantage of some aspects of the invention is to provide a technique that makes it possible to perform copying properly even when a target printed matter includes an image formed on a photoluminescent background.

A main aspect of the invention is to provide a printing apparatus that includes: a first nozzle for ejecting at least one of white ink, clear ink, and photoluminescent ink to form a first dot; and a second nozzle for ejecting color ink to form a second dot, wherein, when forming a color image on a photoluminescent ground layer by means of the second dot, the first dot is formed beneath the second dot that is for forming the color image.

Other features and advantages offered by the invention will be fully understood by referring to the following detailed description in conjunction with the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
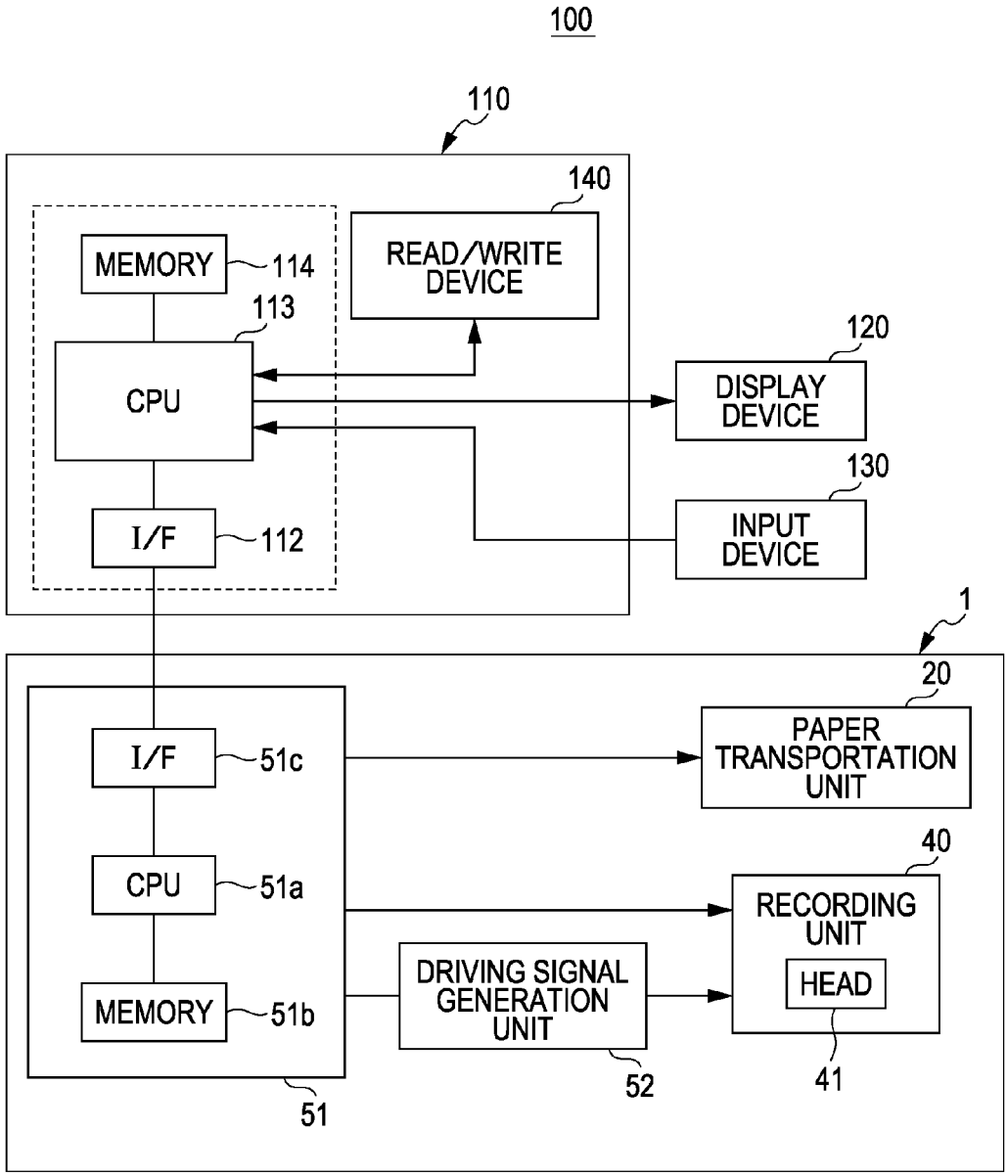
FIG. 1 is a block diagram that schematically illustrates a printing system according to a first embodiment of the invention.

A person skilled in the art will fully understand at least the following matters through reading the detailed description of this specification with reference to accompanying drawings. A printing apparatus that includes: a first nozzle (nozzles) for ejecting at least one of white ink, clear ink, and photoluminescent ink to form a first dot (dots); and a second nozzle (nozzles) for ejecting color ink to form a second dot (dots), wherein, when forming a color image on a photoluminescent ground layer by means of the second dot, the first dot is formed beneath the second dot that is for forming the color image.

Light reflected from a photoluminescent ground layer contains a high percentage of regular reflection light, which means that the percentage of diffused reflection light contained therein is low. For this reason, in some cases, a copying machine fails to perform copying properly. Since the above apparatus forms the first dot, which changes reflectivity, beneath each color-ink dot, diffused reflection light is produced at a position where the color-ink dot is to be formed. Since the percentage of diffused reflection light increases, it is possible to perform copying properly even when a target printed matter includes an image formed on a photoluminescent ground.

In such a printing apparatus, it is preferred that the first dot should be formed at an area where the color image does not exist on the photoluminescent ground layer.

By this means, the first dot increases the percentage of diffused reflection light not only at the area where the color-ink dot is formed but also at the area where no color-ink dot is formed. Thus, it is possible to perform copying properly not only at the area where the color image exists but also at the area where the color image does not exist.

It is preferred that the duty of ejection of the first nozzle when the first dot is formed at the area where the color image does not exist should be 5 to 20%.

By this means, since an adequate amount is ejected to form the first dots at the area where the color image does not exist, it is possible to increase diffused reflection light by an adequate amount and to perform copying properly not only at the area where the color image exists but also at the area where the color image does not exist.

It is preferred that the photoluminescent ink should be ink that contains flakes of aluminum.

By this means, when photoluminescent ink is used, it is possible to produce diffused reflection light properly by means of the flakes of aluminum contained therein.

It is preferred that the photoluminescent ground layer should be a photoluminescent layer that a target medium has.

By this means, even under conditions in which a target medium has a photoluminescent layer and thus a large amount of regular reflection light would be produced if no measures were taken, it is possible to perform copying properly.

The photoluminescent ground layer may include the photoluminescent layer of the target medium and a color ink layer formed on this photoluminescent layer.

By this means, even under conditions in which a target medium has a photoluminescent layer with a color ink layer formed on this photoluminescent layer and thus a large amount of regular reflection light would be produced if no measures were taken, it is possible to perform copying properly.

The apparatus may include ground-forming nozzles for ejecting, onto a target medium, photoluminescent ink that is different from photoluminescent ink that is ejected from the first nozzles onto the target medium, wherein the photoluminescent ink corresponding to the first nozzles is ejected from the first nozzles onto the photoluminescent ground layer formed as a result of the ejection of the photoluminescent ink corresponding to the ground-forming nozzles from the ground-forming nozzles, and the diffused reflectivity of the photoluminescent ink corresponding to the first nozzles is different from the diffused reflectivity of the photoluminescent ink corresponding to the ground-forming nozzles.

By this means, even in a way or mode of printing in which a ground layer is formed on a target medium that does not have a photoluminescent ground layer, it is possible to provide a printed matter that makes it possible to perform copying properly with the adjustment of the percentage of diffused reflection light.

In addition to those stated above, a person skilled in the art will fully understand at least the following matters through reading the detailed description of this specification with reference to accompanying drawings.

A printing method includes: ejecting at least one of white ink, clear ink, and photoluminescent ink to form a first dot at a position where a dot for a color image is to be formed over a photoluminescent ground image of a target medium; and ejecting color ink to form a second dot on the first dot, thereby forming the color image.

Light reflected from a photoluminescent ground layer contains a high percentage of regular reflection light, which means that the percentage of diffused reflection light contained therein is low. For this reason, in some cases, a copying machine fails to perform copying properly. In the above method, the first dot, which changes reflectivity, is formed beneath each color-ink dot. Therefore, diffused reflection light is produced at a position where the color-ink dot is to be formed. Since the percentage of diffused reflection light increases, it is possible to perform copying properly even when a target printed matter includes an image formed on a photoluminescent background.

First Embodiment

FIG. 1 is a block diagram that schematically illustrates a printing system 100 according to a first embodiment of the invention. With reference to the accompanying drawings, the schematic structure/components of the printing system 100 according to the first embodiment of the invention will now be explained.

The printing system 100 includes an ink-jet printer 1 functioning as a printing apparatus (hereinafter simply referred to as "printer 1" where appropriate), a computer 110, a display device 120, and an input device 130. The printer 1 prints an image on a target medium such as printing paper, cloth, film, or the like. The computer 110 is connected to the printer 1. The computer 110 can communicate with the printer 1 via an interface 112. To cause the printer 1 to print an image, the computer 110 outputs print data corresponding to the image to the printer 1. The computer 110 includes a CPU 113, a memory 114, the interface 112, and a read/write device 140. Application programs and computer programs such as a printer driver are installed therein. The read/write device 140 is, for example, a flexible disk drive unit or a CD-ROM drive unit.

An example of the display device 120 is a liquid crystal monitor. The display device 120 displays, for example, a user interface for computer programs. An example of the input device 130 is a keyboard and a mouse.

The ink-jet printer 1 includes a paper transportation unit 20, a recording unit 40, a control unit 51, and a driving signal generation unit 52. The paper transportation unit 20 feeds a print target medium such as printing paper S from a roll R to the recording unit 40 and ejects the printing paper S after printing. The recording unit 40 forms an image on a print target medium by ejecting ink from its head 41 onto the print target medium while moving its carriage 43, on which the head 41 is mounted, as will be described later.

The ink-jet printer 1 is provided with a control unit 51 that centrally controls the operation of each of the above components. The control unit 51 is provided with a CPU 51*a* that performs arithmetic processing, a memory 51*b* that stores programs, the result of arithmetic processing, etc., and an interface 51*c* for communication with an external device. The control unit 51 controls the paper transportation unit 20, the recording unit 40, and the driving signal generation unit 52.

The driving signal generation unit 52 supplies a driving signal COM to each piezoelectric element PZT (described later) of the head 41 of the recording unit 40. Digital data that defines the signal waveform of a driving signal is sent from the control unit 51 to the driving signal generation unit 52. The driving signal generation unit 52 generates the driving signal COM, which is a voltage waveform, on the basis of the digital data.

Figure 2:
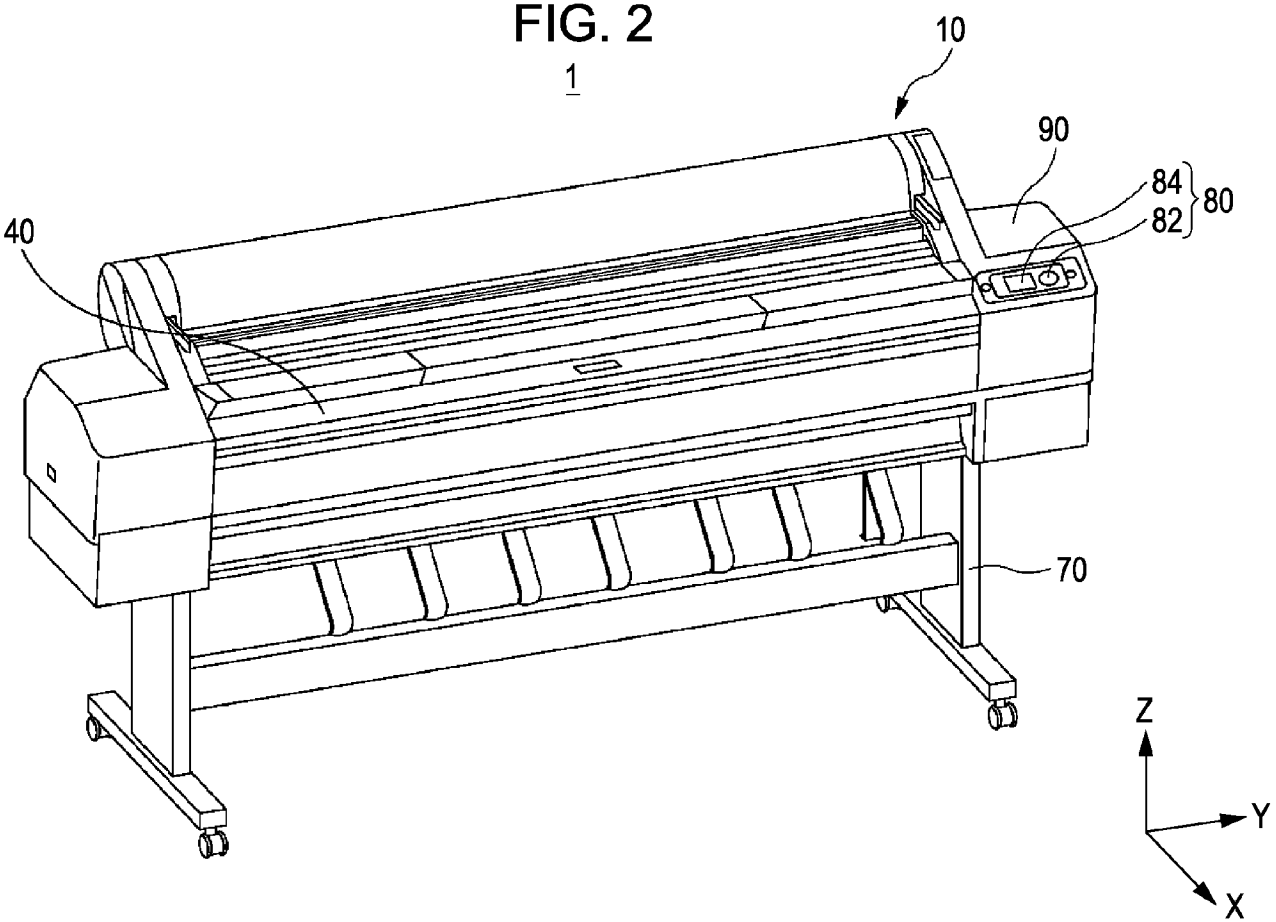
FIG. 2 is a perspective view of an ink-jet printer according to the first embodiment of the invention.
Figure 3:
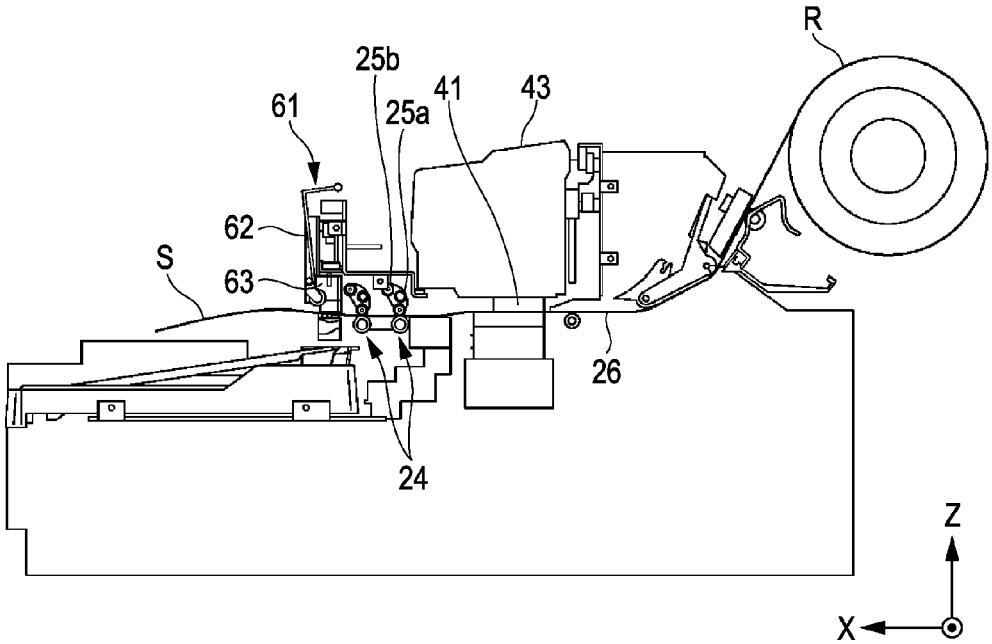
FIG. 3 is a side view of the inner structure of the ink-jet printer according to the first embodiment of the invention.

FIG. 2 is a perspective view of the ink-jet printer 1 according to the first embodiment of the invention. FIG. 3 is a side view of the inner structure of the ink-jet printer 1 according to the first embodiment of the invention. In the following description, the direction in which a print target medium is fed (the direction in which the print target medium is ejected) may be referred to as X-axis direction. The direction of the width of a medium transportation path 26, which is orthogonal to the X-axis direction, may be hereinafter referred to as Y-axis direction (the direction perpendicular to the sheet face of FIG. 3). The direction orthogonal to both the X-axis direction and the Y-axis direction may be hereinafter referred to as Z-axis direction.

As illustrated in FIG. 2, the ink-jet printer 1 includes the recording unit 40, the direction of the length of which is oriented horizontally, a body frame 90, which is attached to the ends of the recording unit 40, a loading unit 10, which is attached above the recording unit 40, and legs 70, which support the recording unit 40 and the body frame 90 from below.

The recording unit 40 is provided with the head 41. The head 41 ejects ink onto a print target medium that is transported along the medium transportation path 26. The head 41 is mounted on the carriage 43, which can move freely in the direction of the width of the medium transportation path 26. Ink cartridges, which are ink containers that are not illustrated in the drawings, are attached to the printer 1. Ink of each color component is supplied from the corresponding one of these ink cartridges to the head 41. A plurality of nozzle lines is formed in the head 41. The head 41 can eject ink of predetermined colors [for example, yellow (Y), magenta (M), cyan (C), black (K), and clear (Cl) (or white (W), metallic (Me))] from these nozzle lines, respectively. The head 41 performs image-forming operation to record predetermined images, characters, and the like on the recording surface of a print target medium by ejecting ink onto the recording surface.

After the image-forming operation performed at the recording unit 40, the print target medium is ejected while being transported by an ejection roller 24. The ejection roller 24 includes a roller-switching mechanism that selects one roller for nipping paper depending on the type of the paper. The switching is performed between a serrated roller 25*a* and a non-serrated roller 25*b*.

A cutting device 61, which cuts the ejected medium into a piece that has a predetermined size, is provided downstream of the ejection roller 24. The cutting device 61 includes a restricting member 62 and a cutter unit 63. The restricting member 62 restricts the position in height of the ejected medium. The cutter unit 63 moves in the width direction (i.e., Y-axis direction), which is orthogonal to the direction of the ejection of the medium (i.e., X-axis direction), to cut the medium.

An operation panel 80 is provided at the top surface of the body frame 90. The operation panel 80 includes a plurality of switches 82, which are to be operated by a user, and a display unit 84, which shows the operation status of the printer 1. A user operates the printer 1 from the front side, wherein the side where the operation panel 80 and a cartridge holder are provided are defined herein as the front side.

Figure 4:
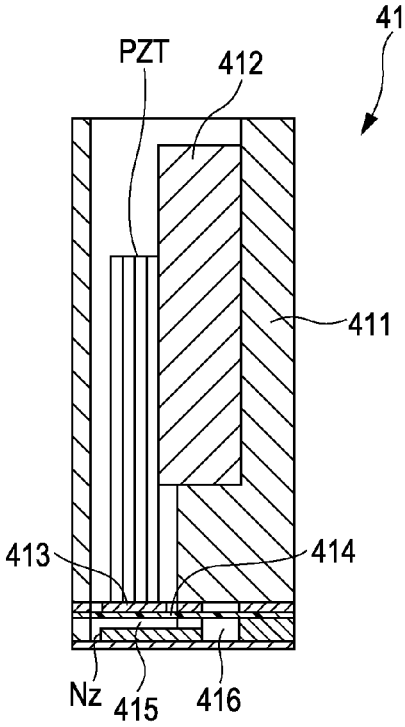
FIG. 4 is a sectional view that schematically illustrates an example of the structure of a head.

FIG. 4 is a sectional view that schematically illustrates an example of the structure of the head 41. A flow passage 416 is formed in the head 41. Ink is supplied through this flow passage 416. A bonding substrate 412 is fixed to the case 411 of the head 41. The bonding substrate 412 is a rectangular plate. The piezoelectric element PZT is bonded to one surface of the bonding substrate 412. An island portion 413 is bonded to the tip of the piezoelectric element PZT. An elastic region that is made of an elastic membrane 414 is formed around the island portion 413.

The piezoelectric element PZT deforms when there is a difference between the level of the electric potential of one electrode and the level of the electric potential of the other electrode, which is provided opposite the one electrode. In this example, the piezoelectric element PZT stretches and shrinks in the direction of the length of the element. The amount of the stretching/shrinking of the piezoelectric element PZT depends on a voltage applied thereto. When the piezoelectric element PZT stretches, the island portion 413 is pushed toward a pressure chamber 415. When the piezoelectric element PZT shrinks, the island portion 413 is pulled away from the pressure chamber 415. In this pushing/pulling process, the elastic membrane 414 surrounding the island portion deforms. Therefore, it is possible to eject ink from each nozzle Nz efficiently.

Since the head 41 has the structure described above, it is possible to discharge ink droplets of more than one size by adjusting the amplitude of a driving signal applied to the piezoelectric element PZT. By this means, it is possible to control the duty of ink ejection adequately.

Figure 5:
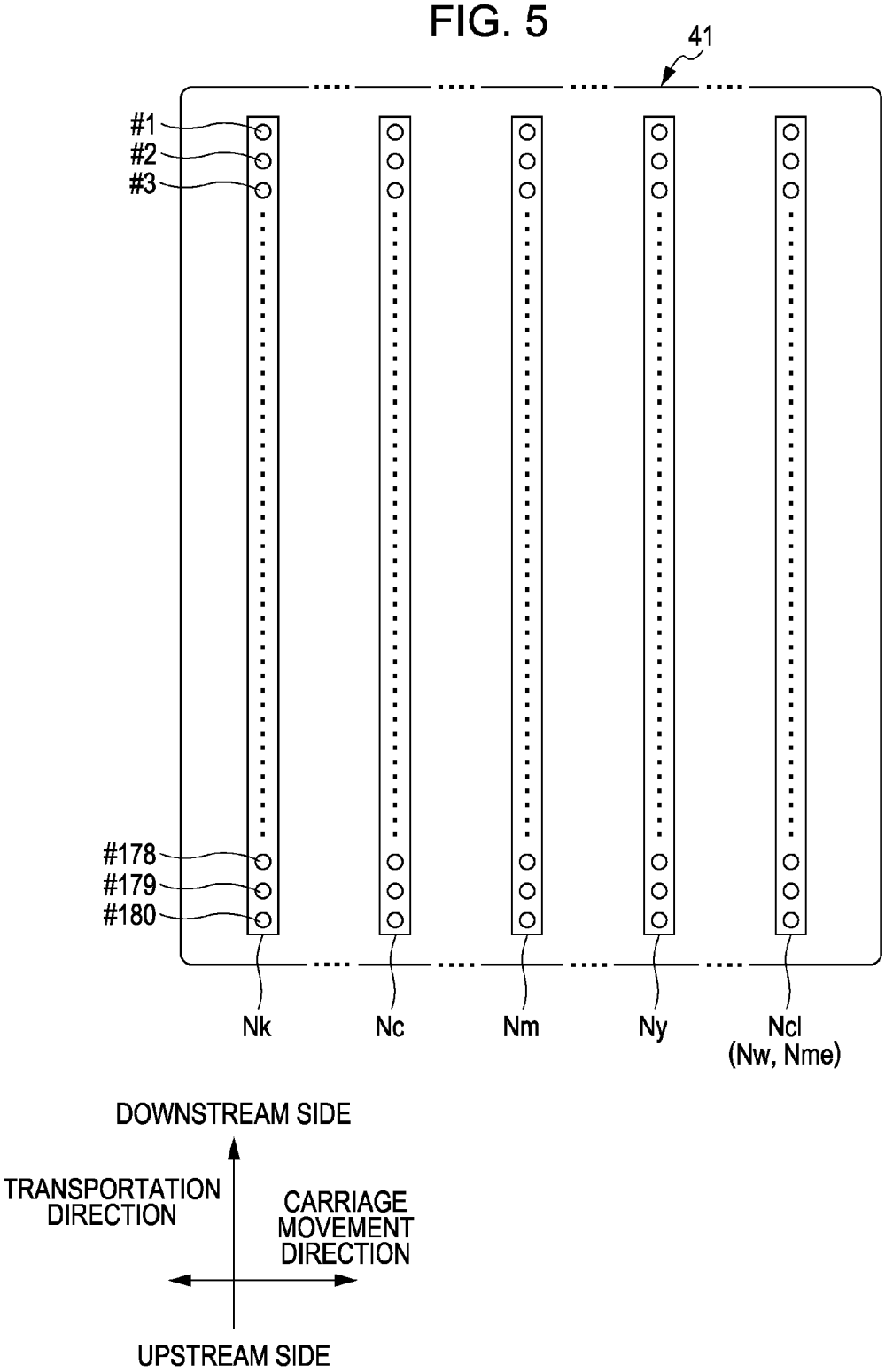
FIG. 5 is a diagram for explaining the nozzles of the head.

FIG. 5 is a diagram for explaining the nozzles of the head 41. The head 41 according to the first embodiment of the invention can eject five types of ink, or more specifically, yellow ink Y, magenta ink M, cyan ink C, black ink K, and clear ink Cl. The clear ink Cl is transparent ink or semitransparent ink.

As will be described later, nozzles for ejecting the clear ink Cl may be replaced with nozzles for ejecting white ink W or nozzles for ejecting metallic ink Me. Though the white ink W is ink that has a white color, in the embodiments described below, the white ink W is distinguished as another type of ink from color types of ink Co (YMCK).

The metallic ink Me will now be explained. The metallic ink Me contains a metal pigment (metallic pigment) and an organic solvent. The material contained in the metallic pigment is not limited to any specific metal. It may be any material as long as it has a metallic luster/gloss or a function that is similar thereto. Preferably, it should be aluminum, aluminum alloy, silver, or silver alloy. The metallic ink is included in photoluminescent ink.

The term "photoluminescent" used herein means surface properties of mirror light reflection. Note that a pigment contained in the photoluminescent ink is not limited to the metal pigment mentioned above. The meaning of the photoluminescent ink encompasses any ink that exhibits surface properties of a metallic luster/gloss or the like. The term "photoluminescent layer", which will be mentioned later, means a layer that has surface properties of mirror light reflection. The term "photoluminescent ground layer" means an underlying layer that has surface properties of mirror light reflection. Therefore, in some embodiments/cases, the photoluminescent layer of a target medium, as a layer alone, corresponds to the photoluminescent ground layer (refer to FIGS. 8 and 9). In another embodiment/case, a photoluminescent layer formed by using photoluminescent ink corresponds to the photoluminescent ground layer (refer to FIG. 12). In still another embodiment/case, a combination of the photoluminescent layer of a target medium and a color ink layer formed on this photoluminescent layer corresponds to the photoluminescent ground layer (refer to FIG. 11).

Five nozzle lines are illustrated in FIG. 5. Black ink is ejected from a black ink nozzle line Nk of the head 41 during the movement of the head 41 in the direction of the movement of the carriage 43. Cyan ink is ejected from a cyan ink nozzle line Nc. Magenta ink is ejected from a magenta ink nozzle line Nm. Yellow ink is ejected from a yellow ink nozzle line Ny. Clear ink is ejected from a clear ink nozzle line Ncl.

Since the head 41 has the nozzle-array structure described above, it is possible to eject the clear ink Cl (or the white ink W, the metallic ink Me) onto a print target medium first, and then eject color ink on the dot/layer of the clear ink Cl (the white ink W, the metallic ink Me).

Figure 6:
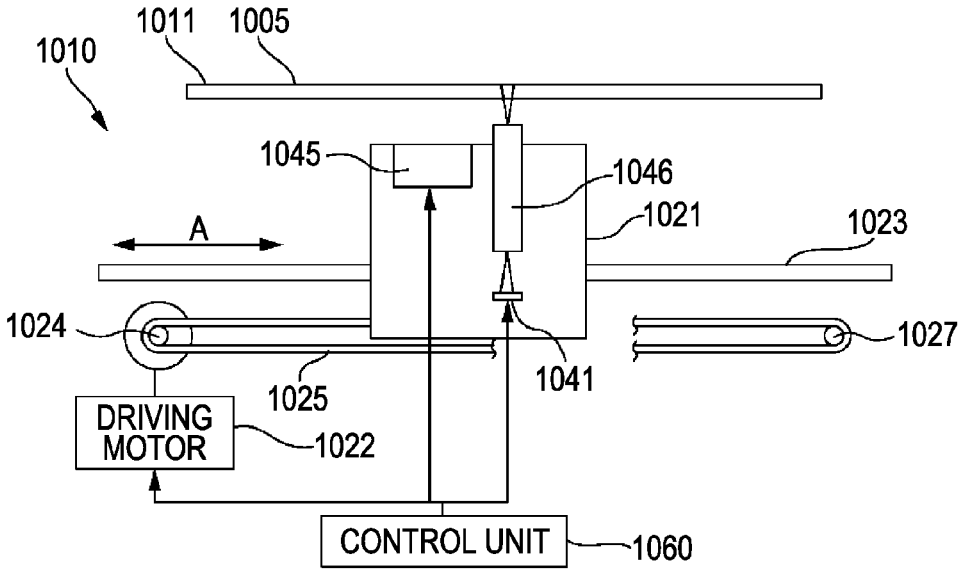
FIG. 6 is a diagram for explaining the structure of a reader mechanism in a copying machine.

FIG. 6 is a diagram for explaining the structure of a reader mechanism in a copying machine. A scanner 1010 is provided with a carriage 1021 and a carriage movement mechanism. The carriage 1021 and the carriage movement mechanism are provided under an original document table 1011. The carriage movement mechanism moves the carriage 1021 in a direction shown by an arrow A in the drawing (i.e., in the sub-scan direction) in parallel with the original document table 1011. The carriage 1021 travels in the sub-scan direction while keeping a predetermined distance from the original document table 1011 during the movement.

The carriage movement mechanism includes a guide 1023 that guides the movement of the carriage 1021 while providing a mechanical support thereto. The carriage 1021 travels along the guide 1023. The carriage movement mechanism further includes a belt 1025, a shaft 1024, a pulley 1027, and a driving motor 1022. The carriage 1021 is fixed to the belt 1025. The belt 1025 is stretched between the shaft 1024 and the pulley 1027. The driving motor 1022 provides a driving force for the rotation of the shaft 1024. The driving motor 1022 operates in accordance with a control signal that is sent from a control unit 1060.

The carriage 1021 includes optical components of the reader mechanism. Specifically, a light-exposure lamp 1045, a lens 1046, and an image sensor 1041 are provided inside the carriage 1021. Functioning as a light source, the light-exposure lamp 1045 sheds light on a sheet of original document 1005 through the original document table 1011. The light emitted from the light-exposure lamp 1045 is reflected at the sheet of original document 1005. Then, the reflected light enters the lens 1046 as diffused reflection light. The image sensor 1041 receives the diffused reflection light that has been taken into the carriage 1021 through the lens 1046.

The image sensor 1041 is configured as a linear CCD sensor, which has an array of photoelectric conversion elements that convert light into an electric signal. An example of such an opto-electric transducer is a photodiode. Image data acquired by the image sensor 1041 is outputted to the control unit 1060. The copying machine copies the original image, etc. onto a target medium such as a sheet of printing paper on the basis of the data of the diffused reflection light inputted into the control unit 1060.

Figure 7:
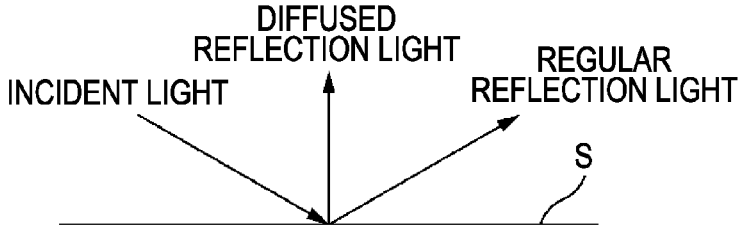
FIG. 7 is a diagram for explaining reflected light and diffused light.

FIG. 7 is a diagram for explaining reflected light and diffused light. It is illustrated therein that incoming light that is incident on a sheet S (target medium) is reflected as regular reflection light (mirror-reflected light) and diffused reflection light. As described above, in the reader mechanism, the image sensor 1041 receives diffused reflection light, which is reflected light obtained as a result of the diffusion, at the target medium, of light emitted from the light-exposure lamp 1045. Therefore, if the ratio of the diffused reflection light to the entire reflected light is adequate, the copying of the target medium will be performed properly. If the ratio of the regular reflection light to the entire reflected light is high, and thus if the ratio of the diffused reflection light to the entire reflected light is low, the copying of the target medium will not be performed properly because the amount of the diffused reflection light is not sufficient. Specifically, the result of the copying will be blackish as viewed as a whole because of the low amount of the diffused reflection light.

An example of a target medium that produces a low percentage of diffused reflection light and a high percentage of regular reflection light is a medium that has a photoluminescent surface. Even when a color image has been printed on such a target medium, most of incident light turns into regular reflection light on the photoluminescent surface of the target medium after having passed through color types of ink that make up the color image. For this reason, when a copying machine copies a target medium that has a photoluminescent surface on which a color image has been printed, the copying of the target medium will not be performed properly.

In view of the above, in the embodiments described below, the percentage of diffused reflection light is increased so that the copying of a target medium will be performed properly even under such conditions.

Figure 8:
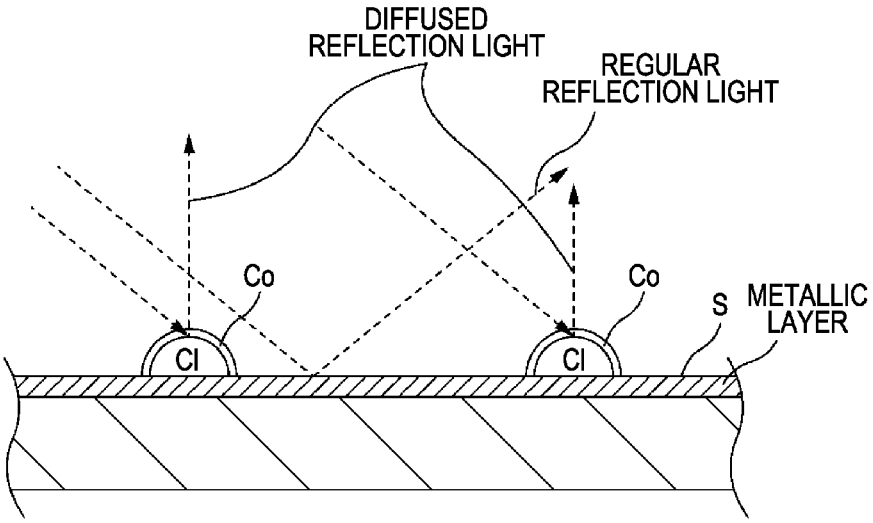
FIG. 8 is a diagram for explaining the forming of dots according to the first embodiment of the invention.

FIG. 8 is a diagram for explaining the forming of dots according to the first embodiment of the invention. The metallic layer of a target medium S and dots formed on this target medium are shown in FIG. 8. The illustrated dots are color dots Co, which are formed by using color types of ink (black K, cyan C, magenta M, and yellow Y). Each of the color dots Co is formed on a clear dot Cl, which is formed by using a clear ink. In FIG. 8, the metallic layer is the photoluminescent ground layer and corresponds to the photoluminescent layer.

A metallic layer reflects most of incident light as regular reflection light. For this reason, if color dots have been formed directly on a metallic layer, most of incident light will be reflected as regular reflection light after having passed through the color dots.

In contrast, with the dot-forming structure according to the first embodiment of the invention, as illustrated in FIG. 8, the clear dots Cl diffuse incident light that has now passed through the color dots Co. Therefore, it is possible to increase the percentage of diffused reflection light. Since a copying machine detects diffused reflection light to perform copying operation as described earlier, it is possible to ensure that the copying machine will be able to copy the original image, etc. properly by intentionally increasing the percentage of diffused reflection light.

To perform the printing described above, ink is ejected while intermittently transporting a target medium in the medium transportation direction and moving the head 41 in the head movement direction. In this process, the clear ink Cl is ejected onto the target medium first, followed by the ejection of the color ink Co onto the dots of the clear ink Cl.

In the explanation given above, it is clear ink that is used to form dots that turn incident light into diffused reflection light intentionally. To modify the above embodiment, white ink may be used as a substitute for the clear ink. Alternatively, metallic ink for producing diffused reflection light may be used as a substitute for the clear ink. As the metallic ink used herein, for example, it is preferred that metallic ink that contains flakes (leaves) of aluminum each of which has the shape of a square of 1 μm on a side and has a thickness of 20 nm should be used. Since the size of such a flake of aluminum is far larger than that of a silver particle (20-nm particle), it is not easily flattened. Therefore, it causes irregular reflection. Thus, it is possible to increase the percentage of diffused reflection light.

Second Embodiment

Figure 9:
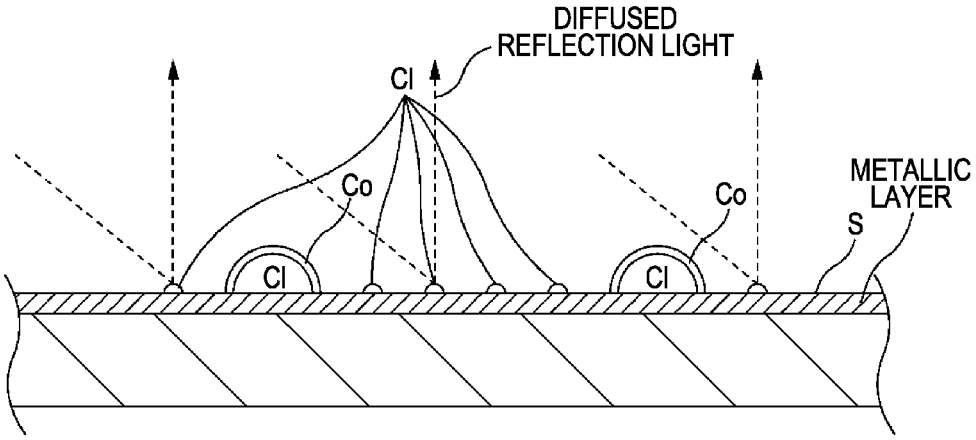
FIG. 9 is a diagram for explaining the forming of dots according to a second embodiment of the invention.

FIG. 9 is a diagram for explaining the forming of dots according to a second embodiment of the invention. The metallic layer of a target medium S (which is the photoluminescent ground layer and corresponds to the photoluminescent layer) and dots formed on this target medium are shown in FIG. 9. In the dot-forming structure illustrated in FIG. 9, as in the dot-forming structure of the first embodiment of the invention described above, there is a clear dot Cl beneath each color dot Co. In addition to the color dots Co, in the dot structure illustrated in FIG. 9, clear dots Cl are formed at an area where no color dot is formed (that is, an area where no color image is formed) with a comparatively low duty of ejection (discharging) (in this example, a duty of ejection of 5 to 20%).

The reason why clear dots are formed at an area where no color dot is to be formed is as follows.

Figure 10:
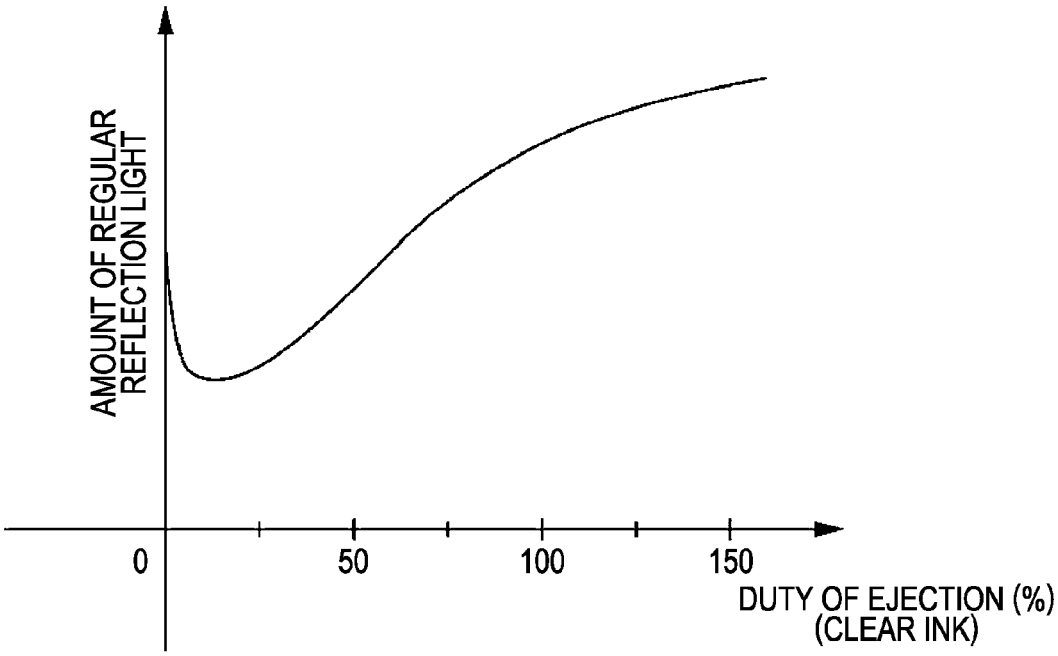
FIG. 10 is a graph that shows the amount of regular reflection light in relation to ink duty.

FIG. 10 is a graph that shows the amount of regular reflection light in relation to ink duty. A relationship between the duty of ejection of clear ink and the amount of regular reflection light is shown in FIG. 10. The term "duty of ejection" means the percentage of an area that is covered by ink per unit area of a target medium. For example, the value "50" of the duty of ejection of clear ink on the horizontal axis of FIG. 10 shows that, if dots are formed with the duty of ejection of 50%, 50% of unit area of a target medium will be covered by ink. As will be understood from FIG. 10, the amount of regular reflection light is the smallest in a range in which the duty of ejection of clear ink is 5 to 20%. To put it another way, the percentage of diffused reflection light is relatively high when the duty of ejection of clear ink is 5 to 20%.

In the first embodiment described above, when the percentage of an area where a color image is formed on a target medium is high, as a matter of course, the percentage of an area where diffused reflection light will be obtained is also high. Therefore, in such a case, the copying of the target medium will be performed properly. When the percentage of an area where a color image is formed on a target medium is low, the percentage of an area where diffused reflection light will be obtained is also low. Therefore, in such a case, there is a risk that the copying of the target medium might not be performed properly.

In contrast, if the dot-forming structure according to the second embodiment of the invention, which is illustrated in FIG. 9, is adopted, since clear dots Cl are formed at an area where no color image (no color dot) is formed, the clear dots Cl turn incident light into diffused reflection light at the area where no color image is formed. Since this increases the ratio of an area for obtaining diffused reflection light to the entire area on the target surface of the medium, it becomes possible to perform the copying of the target medium properly. Especially, since the duty of ejection is adjusted to fall within a range of 5 to 20% to form the clear dots Cl in such a way that the number of the clear dots Cl formed thereat will correspond to the amount by which the diffused reflection light should increase, it is possible to perform the copying of the target medium properly not only at the area where the color image is formed but also at the area where no color image is formed without sacrificing metallic texture.

In the explanation given above, clear dots Cl are formed at an area where no color image is formed. To modify the above embodiment, white ink may be used as a substitute for the clear ink. Alternatively, metallic ink for producing diffused reflection light may be used as a substitute for the clear ink. As the metallic ink used herein, as in the foregoing embodiment, it is preferred that metallic ink that contains flakes of aluminum each of which has the shape of a square of 1 μm on a side and has a thickness of 20 nm should be used.

Third Embodiment

Figure 11:
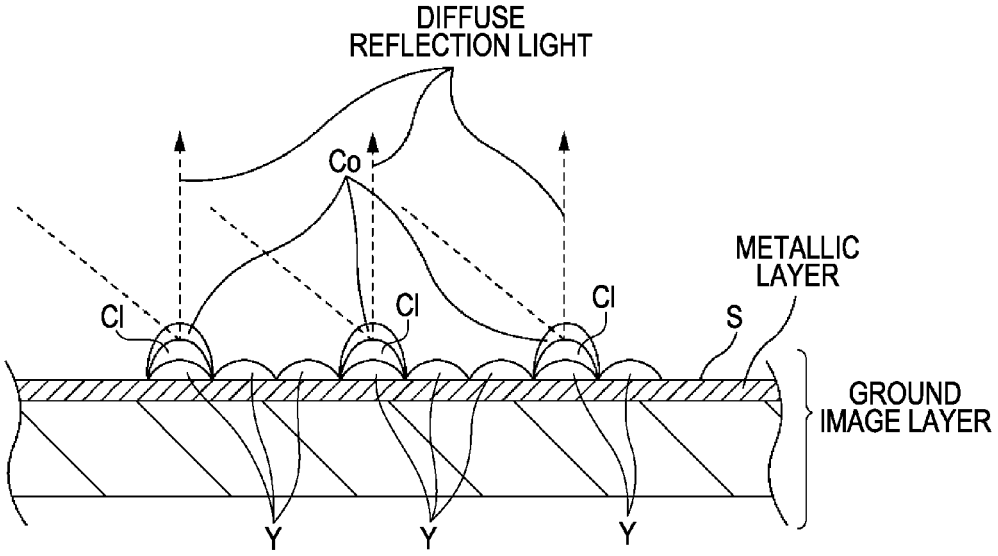
FIG. 11 is a diagram for explaining the forming of dots according to a third embodiment of the invention.

FIG. 11 is a diagram for explaining the forming of dots according to a third embodiment of the invention. As illustrated therein, color ink corresponding to a certain color type is used for solid printing in a wide area on the metallic layer of a target medium S. In this example, yellow ink is used for solid printing. As a result of this solid printing, a yellow background having metallic texture has been formed. In the third embodiment of the invention, a combination of the metallic layer and the yellow (Y) solid print layer corresponds to the ground layer.

The solid print layer formed on the metallic layer is thin. The reason why the solid print layer is thin is that, if it is thick, the ground layer will not have metallic texture. However, there is a possibility that the copying of a target medium will not be performed properly if a color image has been formed directly on such a ground layer because, as described earlier, the percentage of regular reflection light is high, which means that the percentage of diffused reflection light is low.

In view of the above, in the third embodiment of the invention, a clear dot Cl is formed beneath each color dot Co., which is formed over the ground layer, as illustrated in FIG. 11. Because of the structure described above, the clear dots Cl diffuse incident light that has now passed through the color dots Co to increase the percentage of diffused reflection light. This makes it possible to perform the copying of a target medium properly.

Fourth Embodiment

Figure 12:
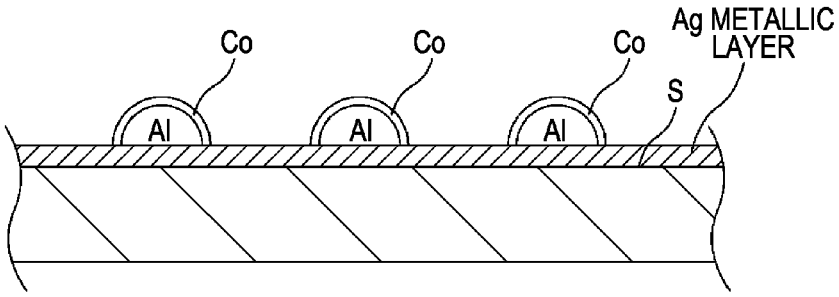
FIG. 12 is a diagram for explaining the forming of dots according to a fourth embodiment of the invention.

FIG. 12 is a diagram for explaining the forming of dots according to a fourth embodiment of the invention. In the foregoing embodiments of the invention, a target medium itself has a metallic layer. However, the scope of the invention is not limited thereto. The printer 1 may form the metallic layer.

In such a modified embodiment, it is preferred that the metallic layer (which corresponds to the photoluminescent ground layer) formed on the target medium should be made of metallic ink that contains silver particles (20-nm particles). Metallic ink that contains the flakes of aluminum mentioned earlier can be used to form metallic dots each of which is formed on the metallic layer mentioned above beneath the corresponding color dot. To eject these two types of metallic ink, one additional nozzle line (a line of ground-forming nozzles) is formed to increase the number of nozzle lines as compared with the nozzle-array structure illustrated in FIG. 5. The line of clear ink nozzles Ncl is used as the nozzle line for ejecting one of the two types of metallic ink. The one additional nozzle line mentioned above is used as the nozzle line for ejecting the other of the two types of metallic ink.

The reason why the type of the metallic ink used for forming the metallic layer is made different from the type of the metallic ink used for forming metallic dots each beneath the corresponding color dot is to make the percentage of regular reflection light of the metallic-layer ink different from the percentage of regular reflection light of the metallic-dot ink. (To put it another way, the reason for this type difference is to make the percentage of diffused reflection light of the metallic-layer ink different from the percentage of diffused reflection light of the metallic-dot ink.) For the purpose of enhancing the visibility of the background having metallic texture, for the metallic layer, it is necessary to increase the percentage of regular reflection light. For this reason, finer silver particles are densely applied onto the target medium. On the other hand, the purpose of forming the metallic dots, each of which is formed beneath the corresponding color dot Co, is to decrease the percentage of regular reflection light and thus increase the percentage of diffused reflection light. For this reason, the flakes of aluminum mentioned earlier, each of which is far coarser than a silver particle, are used to form the metallic dots.

By this means, even when a color image has been formed on a metallic layer wherein the metallic layer itself is formed by means of the printer 1, it is possible to increase the percentage of diffused reflection light, thereby performing the copying of a target medium properly.

Other Embodiments

In the embodiment described above, the metallic ink used for forming the metallic layer as the ground layer contains silver particles, whereas the metallic ink ejected onto the surface of the ground layer contains the flakes of aluminum. However, the combination of the two types of metallic ink is not limited to the above example. Specifically, when the ground layer is made of the metallic ink containing silver particles, the metallic ink ejected onto the surface of the ground layer may contain silver particles instead of containing the flakes of aluminum. When the ground layer is made of the metallic ink containing the flakes of aluminum, the metallic ink ejected onto the surface of the ground layer may contain either the flakes of aluminum or silver particles.

Though the printer 1 is taken as an example in the foregoing embodiment of the inventions, the scope of the invention is not limited thereto. Besides such a printing apparatus, the invention may be applied to, and embodied as, various kinds of liquid discharging apparatuses that eject or discharge various kinds of fluid other than ink (e.g., liquid, a material that is in the form of a liquid in which particles of a functional material is dispersed, or a gel fluid). For example, a technique that is the same as or similar to any of those disclosed in the foregoing embodiments of the invention may be applied to various kinds of apparatuses employing an ink-jet discharging scheme, including but not limited to, a color filter manufacturing apparatus, a dyeing apparatus, a micro-fabrication/micro-machining apparatus, a semiconductor manufacturing apparatus, a surface treatment apparatus, a three-dimensional (3D) modeling apparatus, an aerification/gasification apparatus, an organic electroluminescence (EL) manufacturing apparatus (in particular, a polymer EL manufacturing apparatus), a display manufacturing apparatus, a film deposition apparatus, and a DNA chip manufacturing apparatus. In addition, the scope of the invention encompasses methods and manufacturing methods corresponding to these apparatuses.

Although the present invention is explained above with the disclosure of exemplary embodiments thereof, the specific embodiments described above are provided solely for the purpose of facilitating the understanding of the invention. They are not intended to limit the scope of the invention. Needless to say, the invention may be modified, altered, changed, adapted, and/or improved within a range not departing from the gist and/or spirit of the invention. The scope of the invention encompasses any equivalent.

Head

In the foregoing embodiments of the invention, piezoelectric elements are used for ejecting ink. However, the method for ejecting liquid is not limited to such a piezoelectric scheme. An alternative method such as, for example, a thermal method that utilizes bubbles produced in nozzles due to heat may be used.

What is claimed is:

1. A printing apparatus, comprising:

a first nozzle for ejecting clear ink to form a first dot; and a second nozzle for ejecting color ink to form a second dot, wherein, when forming a color image on a photoluminescent ground layer by means of the second dot, the first dot is formed at an area where the color image does not exist.

2. The printing apparatus according to claim 1, wherein a duty of ejection of the first nozzle when the first dot is formed at the area where the color image does not exist is 5 to 20%.

3. The printing apparatus according to claim 2, wherein the photoluminescent ground layer is a photoluminescent layer that a target medium has.

4. The printing apparatus according to claim 3, wherein percentage of diffused reflection light of the clear ink is higher than percentage of diffused reflection light of the ground layer.

5. A printing method, comprising:

ejecting at least one of white ink, clear ink, and photoluminescent ink to form a first dot at a position where a dot for a color image is to be formed over a photoluminescent ground image of a target medium; and ejecting color ink to form a second dot on the first dot, thereby forming the color image.

6. A printing apparatus, comprising:

a first nozzle for ejecting at least one of white ink, clear ink, and photoluminescent ink to form a first dot; and a second nozzle for ejecting color ink to form a second dot, wherein, when forming a color image on a photoluminescent ground layer by means of the second dot, the first dot is formed beneath the second dot that is for forming the color image.

* * * * *